US009840831B1

(12) United States Patent
Esche et al.

(10) Patent No.: US 9,840,831 B1
(45) Date of Patent: Dec. 12, 2017

(54) SPRAYHEAD RETRACTION ASSEMBLY

(71) Applicant: Kohler Co., Kohler, WI (US)

(72) Inventors: John C. Esche, Kohler, WI (US); Daniel E. Smith, Sheboygan Falls, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/180,974

(22) Filed: Jun. 13, 2016

(51) Int. Cl.
*E03C 1/04* (2006.01)

(52) U.S. Cl.
CPC .... *E03C 1/0404* (2013.01); *E03C 2001/0417* (2013.01)

(58) Field of Classification Search
CPC ..... E03C 1/0404
USPC ..... 4/675, 678
See application file for complete search history.

(56) References Cited

U.S. PATENT DOCUMENTS

| | | | | |
|---|---|---|---|---|
| 2,026,327 | A | 12/1935 | Sparling | |
| 2,095,241 | A | 10/1937 | Cox | |
| 2,875,496 | A | 3/1959 | Fox | |
| 3,612,318 | A | 10/1971 | Ramsey | |
| 5,117,859 | A | 6/1992 | Carlson | |
| 5,775,354 | A | 7/1998 | Upton | |
| 6,234,192 | B1 | 5/2001 | Esche et al. | |
| 6,738,996 | B1 * | 5/2004 | Malek | B05B 1/1618 239/441 |
| 6,877,172 | B2 * | 4/2005 | Malek | E03C 1/0404 239/587.1 |
| 6,915,817 | B2 | 7/2005 | Benstead et al. | |

* cited by examiner

*Primary Examiner* — Lori Baker
(74) *Attorney, Agent, or Firm* — Foley & Lardner LLP

(57) ABSTRACT

A sprayhead retraction assembly includes a first member defining first and second projections, a first pulley axially connected to the first projection, the first pulley configured to receive a hose, a second pulley axially connected to the second projection, and a constant-force spring defining a first end and a second end, wherein the first end is coupled to the second pulley, such that the constant-force spring is configured to coil around the second pulley, and wherein the second end is configured to be coupled to a surface.

14 Claims, 10 Drawing Sheets

SPRAYHEAD RETRACTION ASSEMBLY

BACKGROUND

The present application relates generally to the field of kitchen fixtures. In particular, the present application relates to an assembly for retracting a sprayhead into a spout for docking.

Conventionally, a faucet with a removable sprayhead connected to a hose may include a counterweight on the hose positioned beneath the faucet to apply a force on the hose to retract the sprayhead toward the spout. The counterweight provides a constant retraction force for biasing the sprayhead toward the spout, but does not prevent the hose from disturbing items stored beneath a sink, where the hose is stored. Other biasing mechanisms (e.g., springs) increase in resistance as the hose is withdrawn and therefore do not provide the desirable constant retraction force.

SUMMARY

One embodiment relates to a sprayhead retraction assembly including a first member defining first and second projections, a first pulley axially connected to the first projection, the first pulley configured to receive a hose, a second pulley axially connected to the second projection, and a constant-force spring defining a first end and a second end, wherein the first end is coupled to the second pulley, such that the constant-force spring is configured to coil around the second pulley, and wherein the second end is configured to be coupled to a surface.

Another embodiment relates to a sprayhead retraction assembly including a first member defining first and second projections, a first pulley axially connected to the first projection, the first pulley configured to receive a hose, and a second pulley axially connected to the second projection. The assembly further includes a third pulley configured to redirect the hose between an outlet end of the hose and the first pulley, and a constant-force spring defining a first end and a second end, wherein the first end is coupled to the second pulley, such that the constant-force spring is configured to coil around the second pulley, and wherein the second end is configured to be coupled to a surface.

Another embodiment relates to a method of installing a sprayhead retraction assembly including receiving, in a groove defined by a first pulley, a hose. The method further includes coupling a first end of a constant-force spring to a surface below a sprayhead, coupling a second end of the constant-force spring to a second pulley, and coiling the constant-force spring around the second pulley, the second pulley coupled to and offset from the first pulley.

DETAILED DESCRIPTION

Referring generally to the FIGURES, a faucet having a constant-force retraction assembly (i.e., system) is shown according to an exemplary embodiment. The faucet includes a body, a spout, and a sprayhead releasably coupled to the spout. A hose carries fluid through the spout to the sprayhead, where the fluid is ejected (e.g., released, sprayed, output) to the environment, for example, into a basin, sink, tub, or shower stall.

Figure 1A:
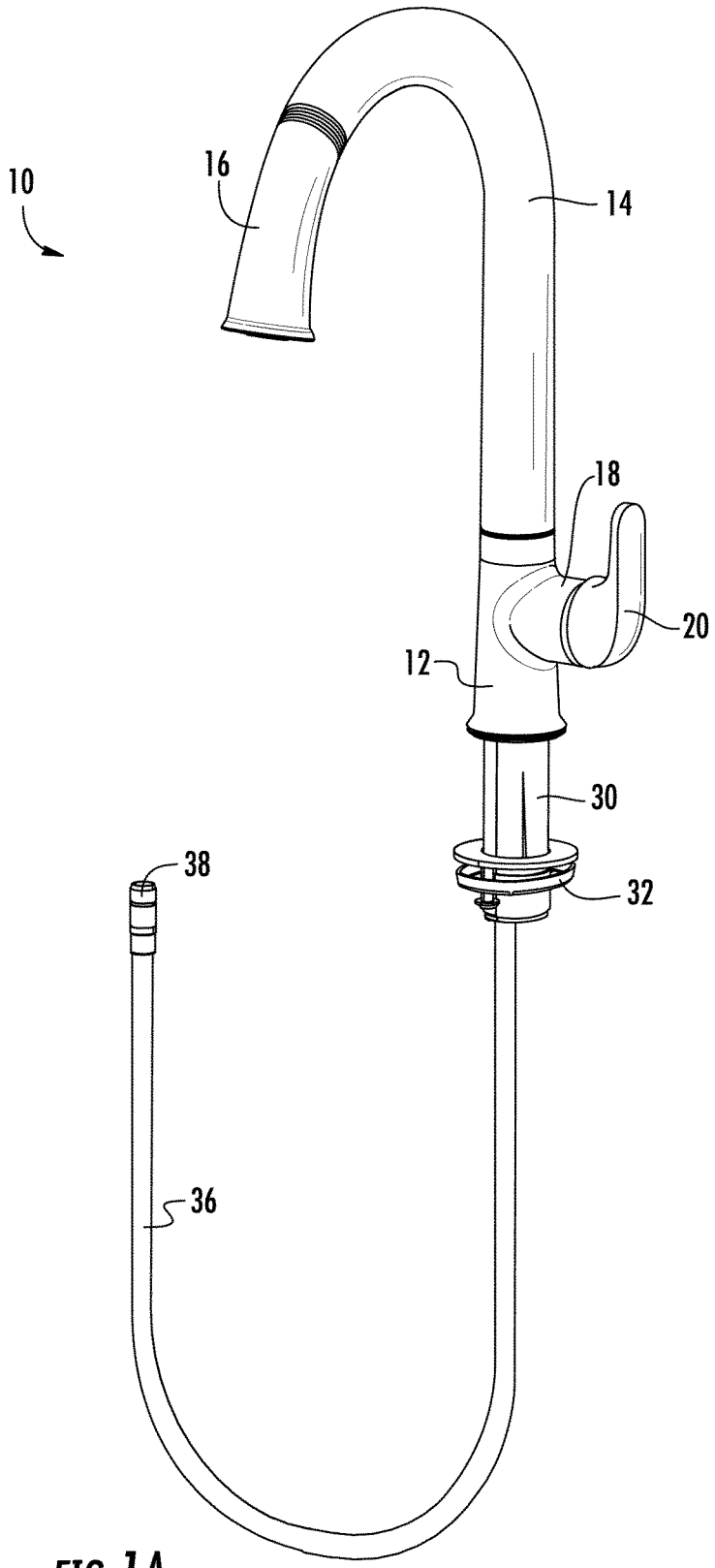
FIG. 1A is a perspective view of a faucet with a sprayhead in a docked position.
Figure 1B:
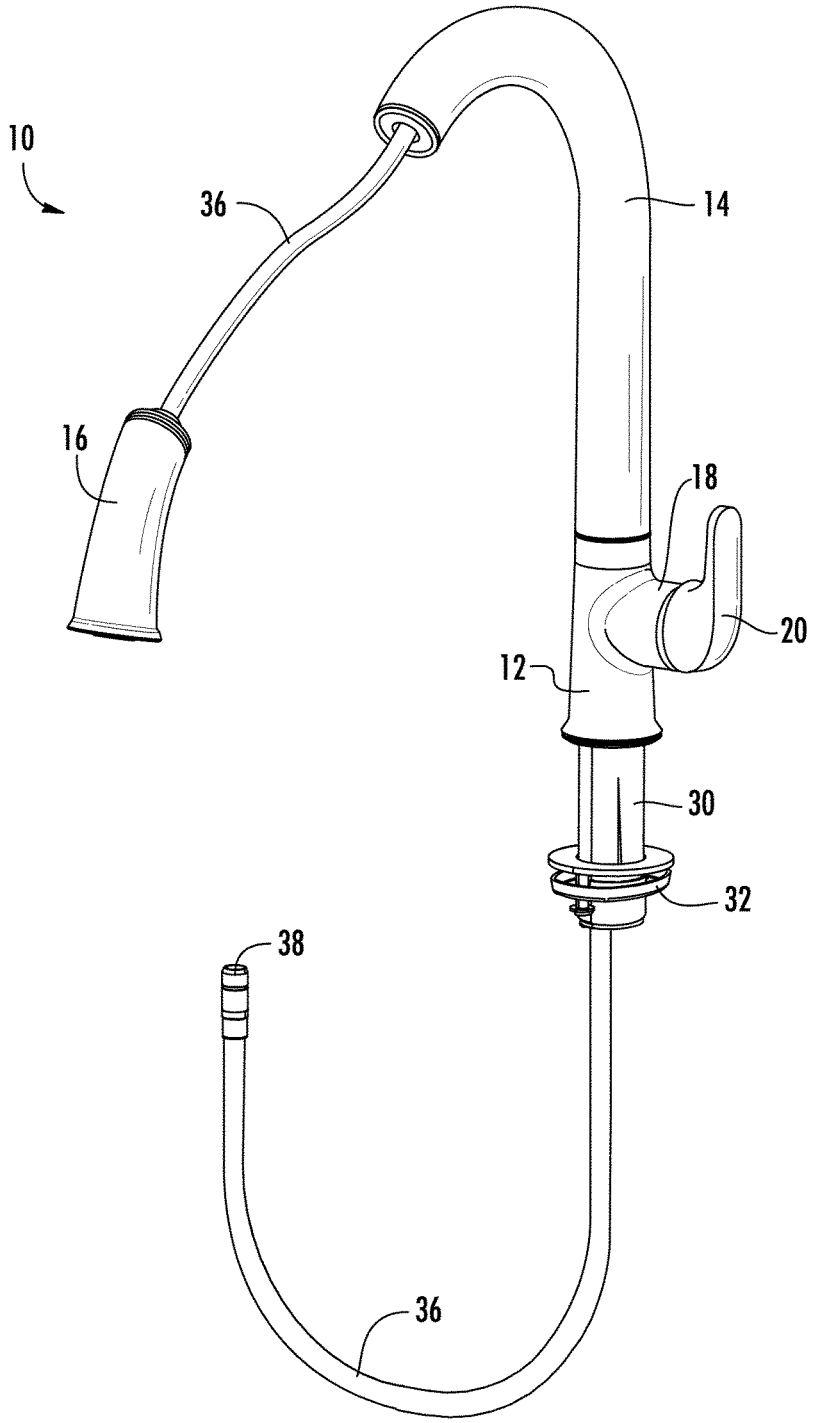
FIG. 1B is a perspective view of the faucet of FIG. 1A with the sprayhead in an undocked position.

The faucet shown in FIG. 1A is shown in a first or docked position, in which the sprayhead is coupled to and received in the spout. The faucet shown in FIG. 1B is shown in a second or undocked position. In the undocked position, the sprayhead is decoupled and spaced apart from the spout. In such a position, the hose is at least partially extracted from the spout. According to the embodiments shown, a constant-force retraction assembly is configured to retract the sprayhead from the undocked position to the docked position.

Referring to FIGS. 1A and 1B, a faucet with a retractable spout is shown, according to an exemplary embodiment. A faucet 10 includes a base 12, a spout 14, and a sprayhead 16 releasably coupled to (e.g., received in, engaging, etc.) the spout 14. The faucet 10 is shown to include an arm 18 configured to house and support a manual valve (not shown). The valve may be configured to control the volume, temperature, or some combination thereof, of the fluid (e.g., water, beverage, etc.) flow through the faucet 10. A handle 20 is coupled to the valve to control the operation thereof. According to other embodiments, the faucet 10 may not include an arm 18, and the valve and handle 20 may be located remotely from the faucet 10. According to various other embodiments, the faucet 10 may include an electronically controlled valve (e.g., solenoid valve) in addition to or instead of the manual valve.

Figure 2:
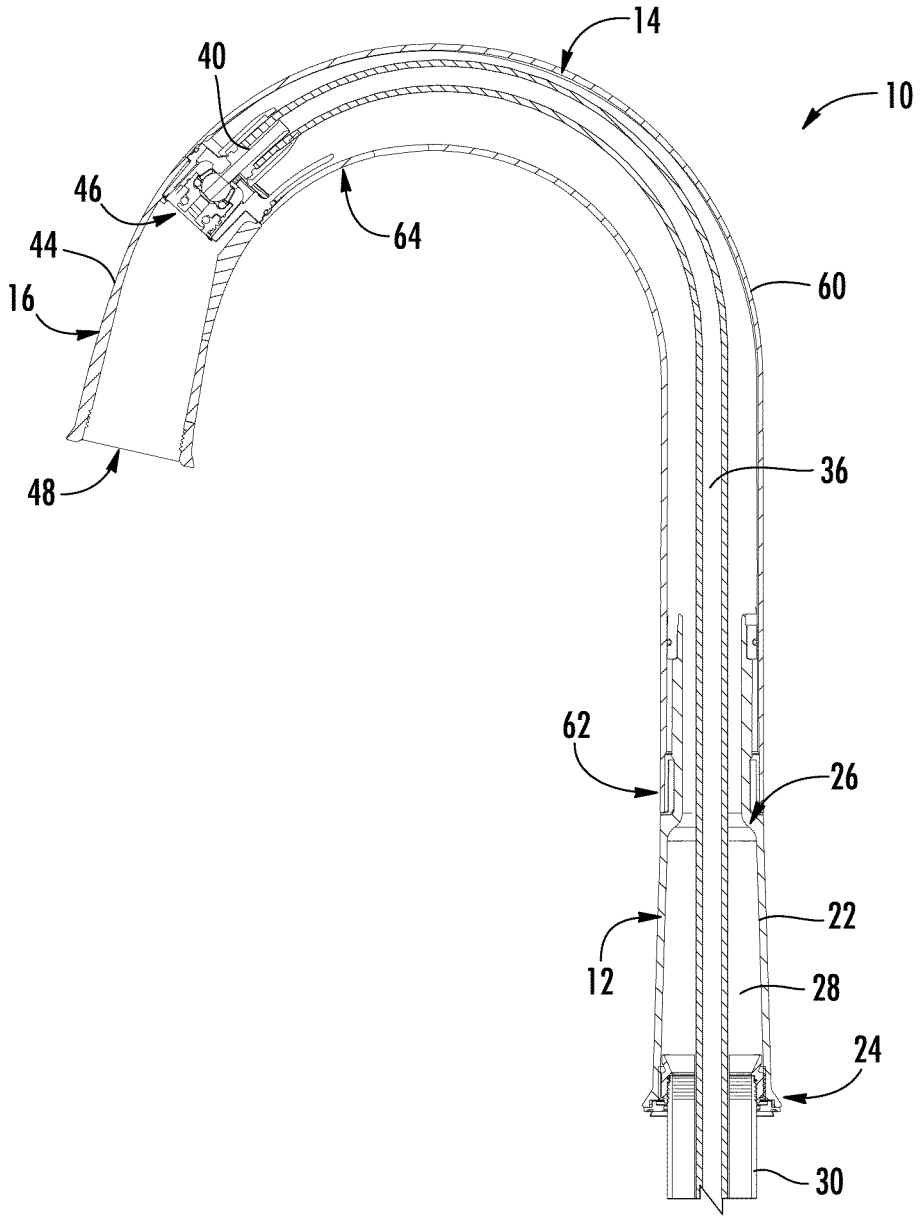
FIG. 2 is a cross-sectional plan view of the faucet of FIG. 1A.
Figure 6:
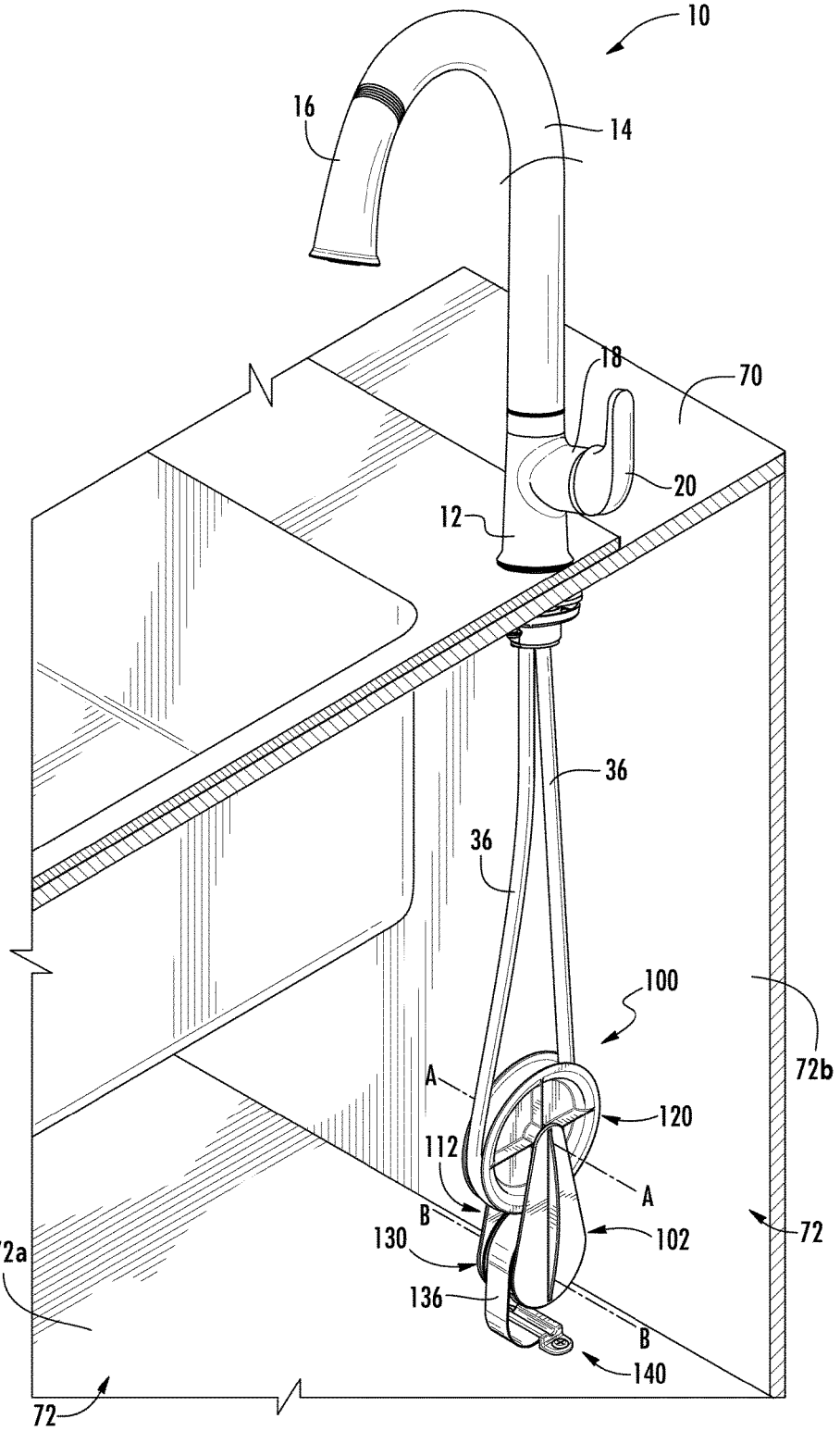
FIG. 6 is a perspective view of a sprayhead retraction assembly and faucet in a docked position, according to an exemplary embodiment.
Figure 7:
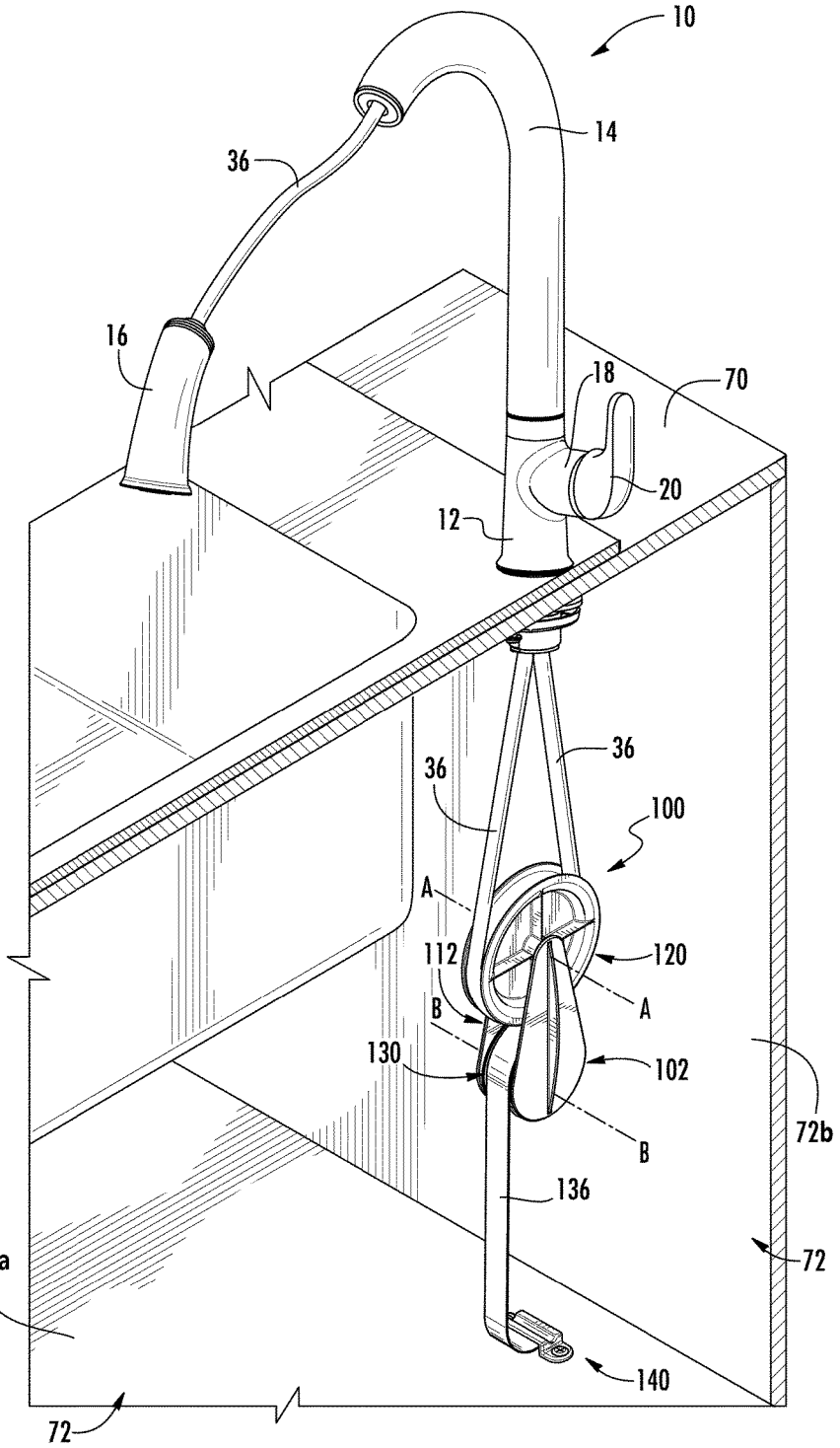
FIG. 7 is a perspective view of the sprayhead retraction assembly and faucet of FIG. 6 in an undocked position.

Referring to FIG. 2, the base 12 includes a sidewall 22, extending between a first or bottom end 24 to a second or top end 26, and an axially extending cavity 28. The bottom end 24 is configured to provide stable support to the faucet 10 when coupled to a first surface 70 (e.g., countertop, wall, bar, table, support structure, etc.), as shown in FIG. 7. A stem 30 may be threadedly coupled to the bottom end 24 to extend through the first surface 70 as shown in FIGS. 6-9 and to couple to a clamping mechanism 32 configured to couple the stem 30 to an opposite side (e.g., underside, inside, etc.) of the first surface 70. According to an exemplary embodiment, the first surface 70 is a sink or countertop over a cabinet, the countertop receiving the sink therein.

Referring still to FIG. 2, the sidewall 22 is shown to at least partially define the cavity 28, which is configured to receive and permit the passage therethrough of water lines (not shown). For example, the cavity 28 may receive a cold water line (not shown) and a hot water line (not shown). The faucet 10 further includes an outlet line, shown as hose 36, according to an exemplary embodiment. The hose 36 is configured to carry water through the spout 14 to the sprayhead 16 and is sufficiently flexible to permit the hose to travel through the shape of the spout 14 while the sprayhead 16 is moved between the docked and undocked position. According to the exemplary embodiment shown, the hose 36 extends from a first or inlet end 38, which fluidly couples to the valve, to a second or outlet end 40, which fluidly couples to the sprayhead 16.

Further referring to FIG. 2, the sprayhead 16 includes a sidewall 44 extending between a first or inlet end 46 and a second our outlet end 48. The sprayhead 16 transfers fluid from the hose 36 to an outlet port. For example, the sprayhead 16 may include an aerator and one or more non-aerated nozzles. A diverter mechanism controlled by a switch may transition the flow between modes, e.g., divert flow to the aerator, to the nozzles, or pause the flow of fluid through the sprayhead 16.

The spout 14 includes a sidewall 60 extending from a first or bottom end 62 to a second or top end 64. The bottom end 62 couples to the top end 26 of the base 12. According to other embodiments, the spout 14 may be fixed to the base 12, but according to the embodiment shown, the spout 14 is rotatably coupled to the base 12 to provide direction and range of the outlet flow of fluid to the environment, i.e., provides a greater usable work area. The top end 64 is configured to releasably couple to the sprayhead 16.

Figure 3:
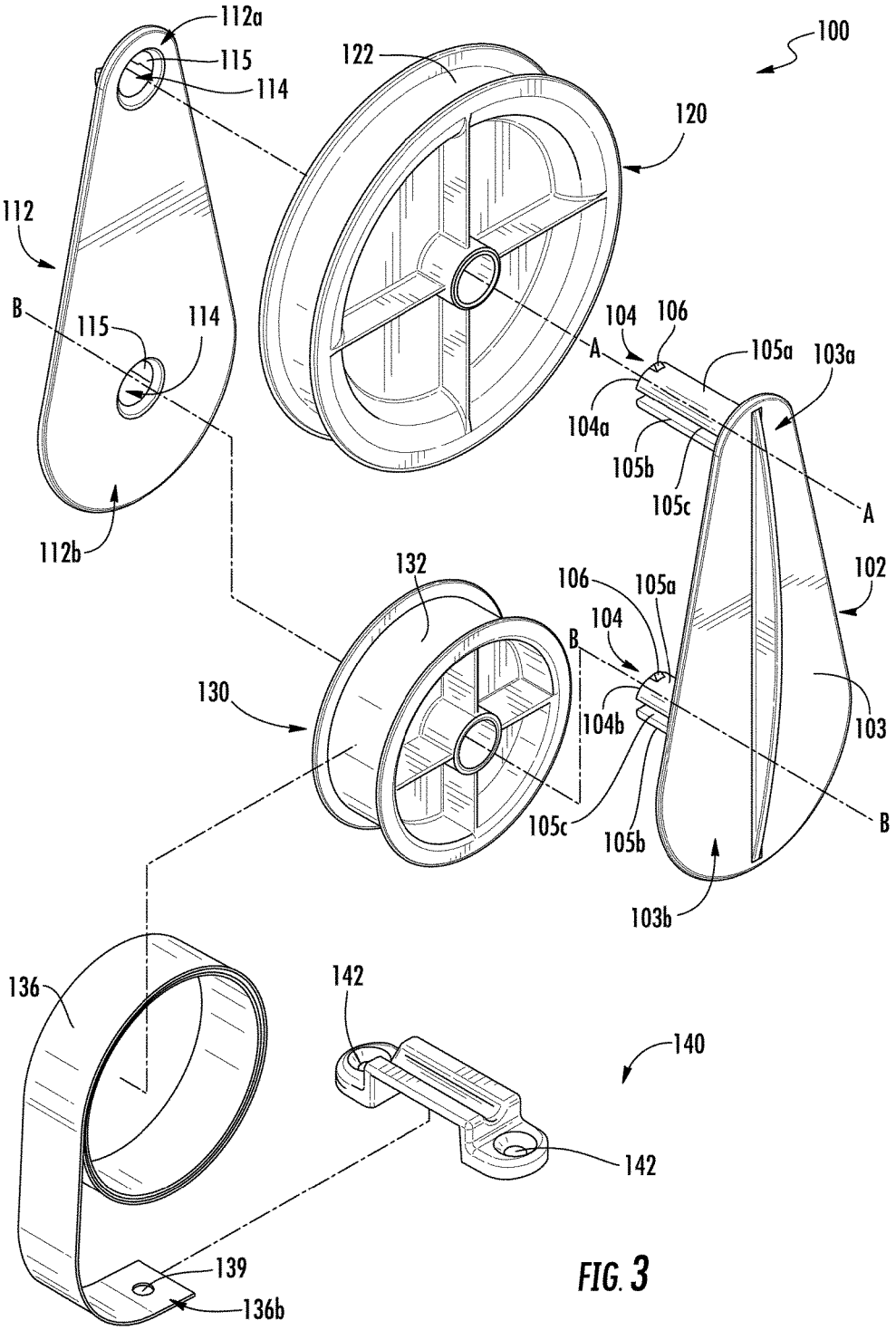
FIG. 3 is a top perspective exploded view of a sprayhead retraction assembly, according to an exemplary embodiment.
Figure 4:
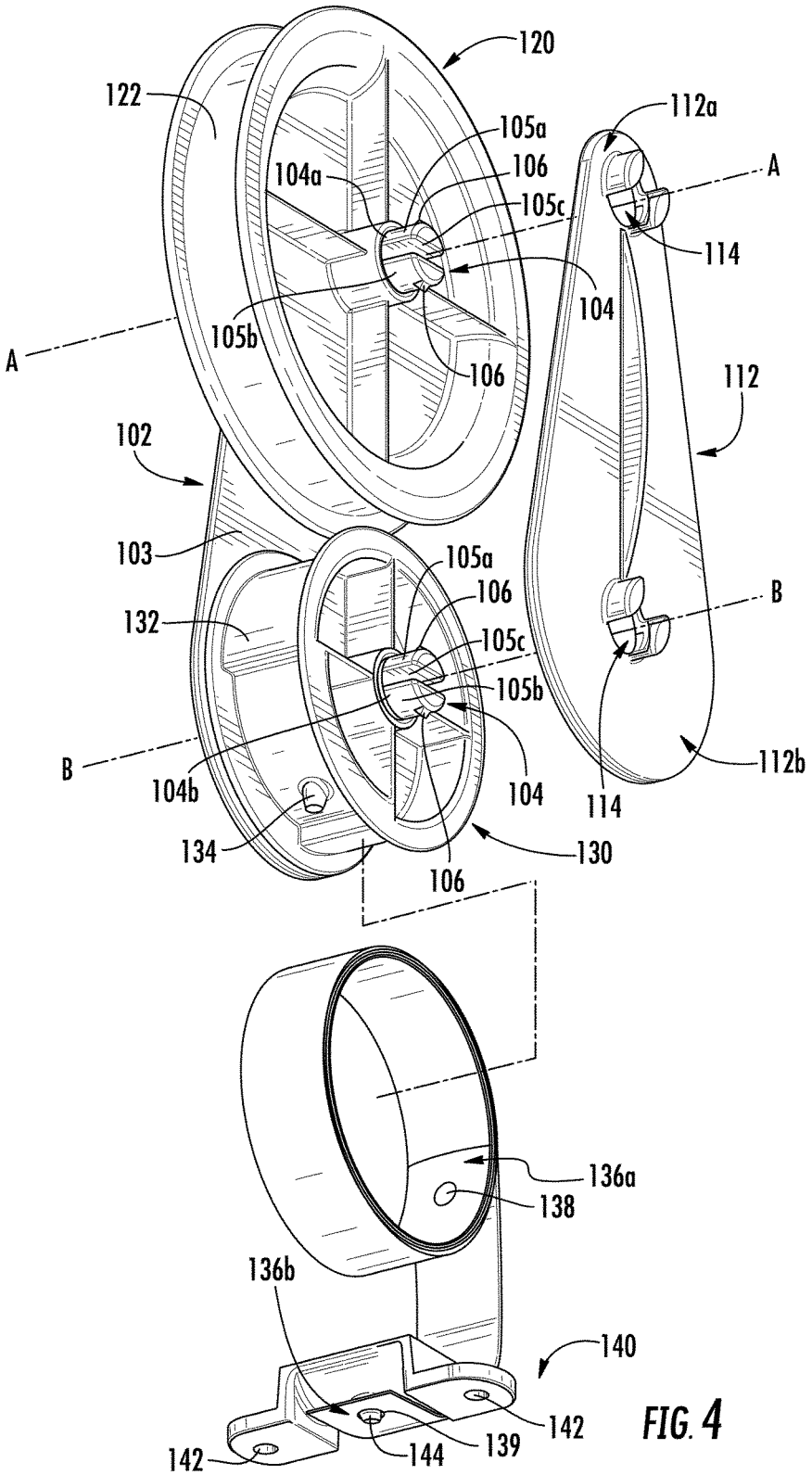
FIG. 4 is a bottom perspective partially-assembled view of the sprayhead retraction assembly of FIG. 3.
Figure 5:
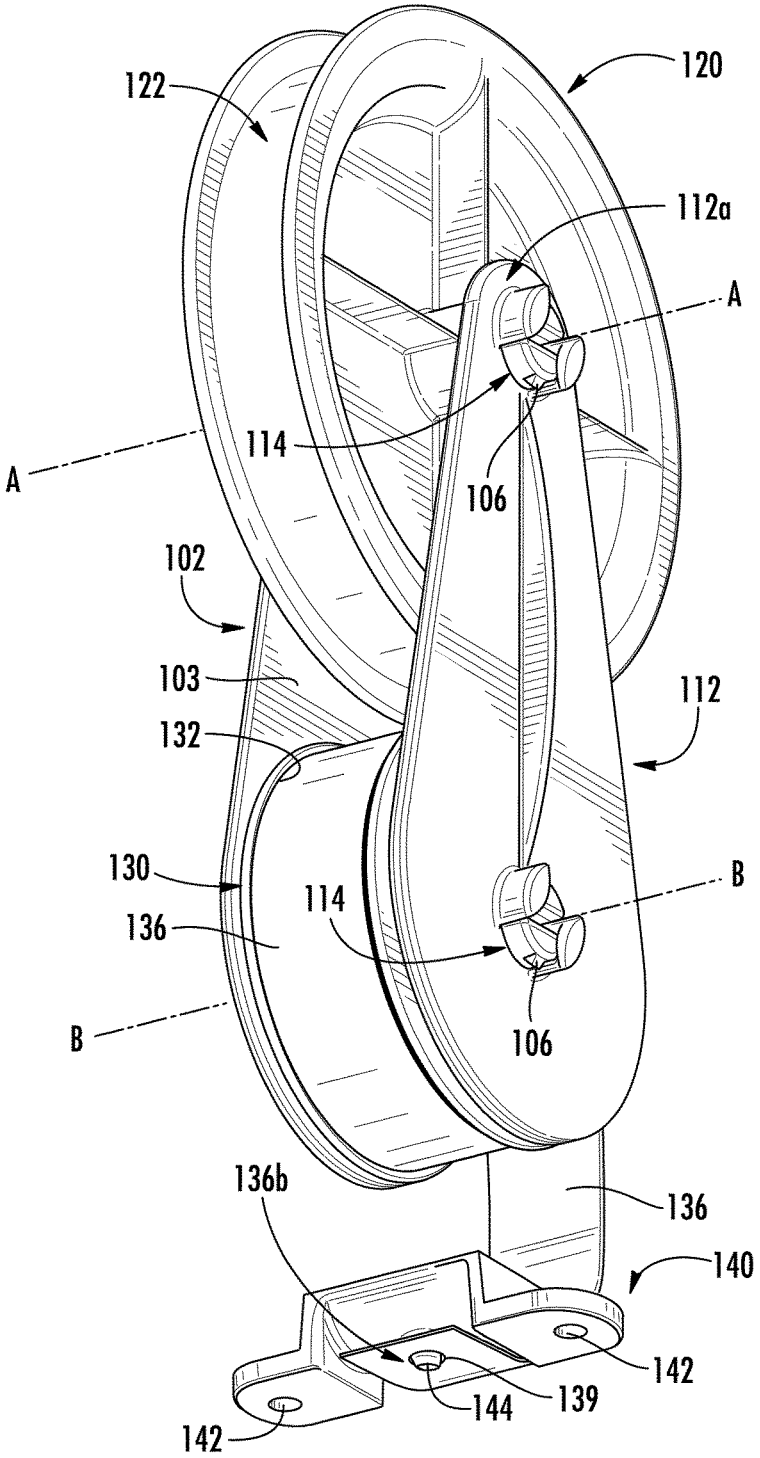
FIG. 5 is a bottom perspective view of the sprayhead retraction assembly of FIG. 3.

Referring to FIGS. 3-5, a sprayhead retraction assembly 100 is shown according to an exemplary embodiment. The assembly 100 includes a first member 102 having a body 103, including an upper end 103*a* and a lower end 103*b*. The assembly 100 further includes a second member 112 coupled (e.g., removably coupled) to the first member 102. According to an exemplary embodiment, each of the members 102, 112 is generally planar. The first member 102 includes a plurality of projections 104 extending substantially perpendicular to the body 103, where each projection 104 is configured to axially engage a pulley. As shown in FIGS. 3 and 4, the first member 102 includes one projection 104 extending from each of the upper end 103*a* and lower end 103*b* of the body 103. According to another exemplary embodiment, more or fewer projections 104 may be used. The second member 112 defines a plurality of openings 114, each configured to receive a corresponding projection 104 for coupling the second member 112 to the first member 102. As shown in FIG. 4, the second member 112 includes one opening 114 defined in each of an upper end 112*a* and a lower end 112*b*. According to another exemplary embodiment, more or fewer openings 114 may be defined. According to another exemplary embodiment, the number of openings 114 in the second member 112 may match the number of projections 104 in the first member 102.

Referring to FIGS. 3 and 4, each projection 104 is generally cylindrical. Each projection 104 further includes an upper portion 105*a* and a lower portion 105*b* defining a slot 105*c* therebetween, the slot 105*c* configured to allow the upper portion 105*a* and lower portion 105*b* to be compressed toward each other. Catches 106 extend axially outward from each of the upper portion 105*a* and lower portion 105*b* at an end of the projection 104 opposed to the body 103. According to an exemplary embodiment, each of the projections 104 are formed from a plastic or other compressible (i.e., deformable) material.

The openings 114 of the second member 112 are configured to receive the projections 104 of the first member 102 with an interference fit. For example, when the first projection 104 is inserted into the first opening 114, the upper portion 105*a* and the lower portion 105*b* are compressed toward each other, such that the catches 106 may be received within the opening 114. Thereafter, the upper portion 105*a* and the lower portion 105*b* are released and return to a decompressed state, such that the catches 106 extend beyond a diameter 115 of the first opening 114, forming the interference fit. In this configuration, the first projection 104 cannot be withdrawn from the first opening 114 without first compressing the upper and lower portions 105*a*, 105*b* of the first projection 104. According to another exemplary embodiment, the first member 102 may be coupled to the second bracket in other ways (e.g., nut and bolt, rivet, weld, etc.).

The assembly 100 includes a first pulley 120 and a second pulley 130 offset from the first pulley 120. As shown in FIG. 4, the first pulley 120 is axially coupled to a first projection 104*a* extending from the upper end 103*a* of the first member 102 and the second pulley 130 is axially coupled to a second projection 104*b* extending from the lower end 103*b* of the first member 102. Each of the pulleys 120, 130 may be received by a corresponding projection 104 with an interference fit, as described above. According to an exemplary embodiment, more or fewer pulleys 120, 130 may be used. According to another exemplary embodiment, the number of pulleys 120, 130 matches the number of projections 104 in the first member 102.

The first pulley 120 defines a groove 122 configured to receive the hose 36 therein. The hose 36 may engage the first pulley 120 such that when the hose 36 moves between the docked and undocked positions, the first pulley 120 moves along a length of the hose 36 while freely rotating about axis A-A. The first pulley 120 is configured to maintain contact with the hose 36 regardless of the position of the sprayhead 16. For example, the first pulley 120 applies constant tension to the hose 36 away from the first surface 70, ensuring such contact.

Figure 9:
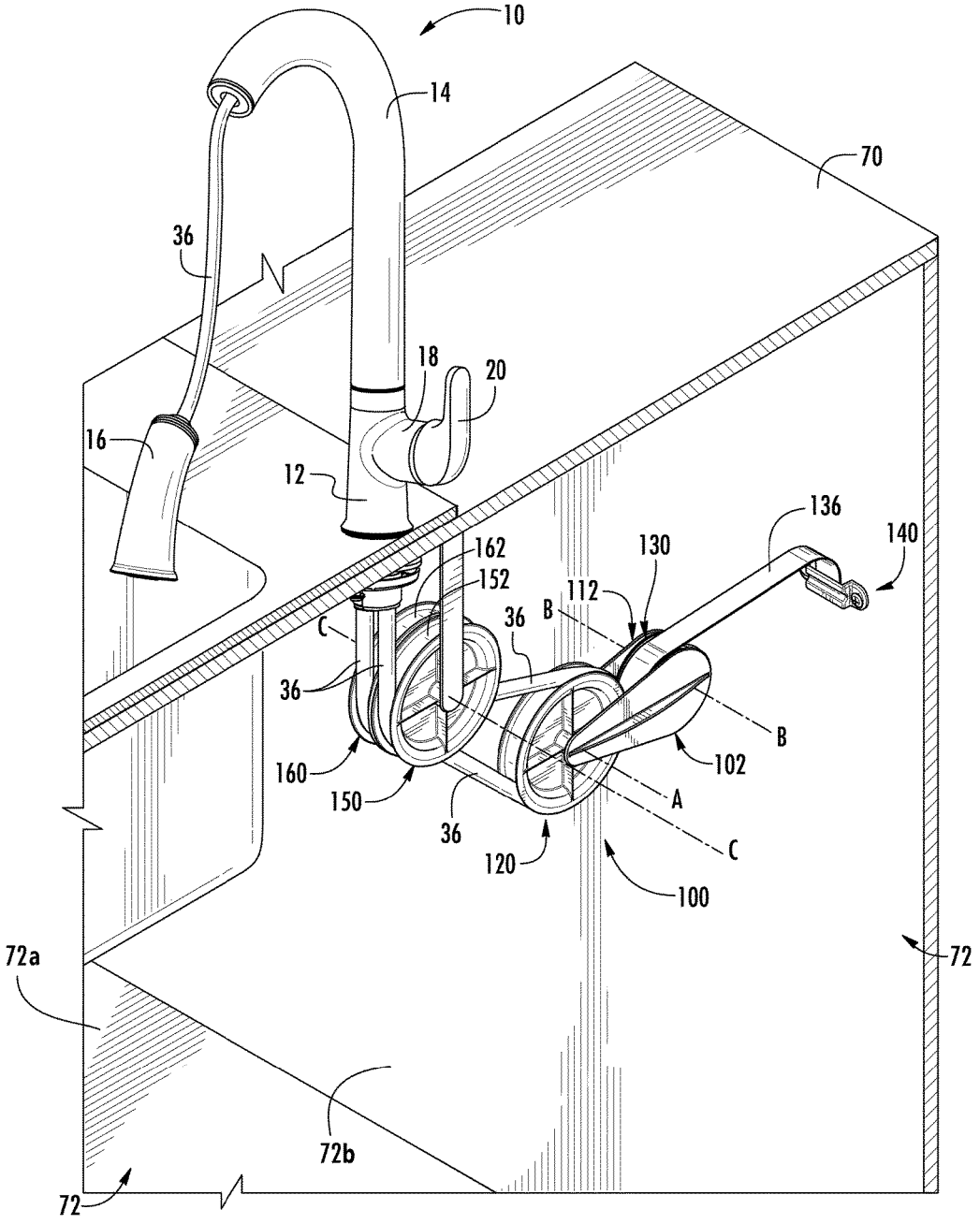
FIG. 9 is a perspective view of the sprayhead retraction assembly and faucet of FIG. 8 in an undocked position.

The second pulley 130 defines a groove 132 configured to receive a constant-force spring 136 therein. As shown in FIG. 4, the second pulley 130 includes a peg 134 configured to engage the constant-force spring 136 and the constant-force spring 136 defines a hole 138 at a first end thereof 136*a*. The hole 138 receives the peg 134, coupling the second pulley 130 and the constant-force spring 136 such that the first end 136*a* of the constant-force spring 136 is rotationally fixed to a position along a circumference of the second pulley 130. According to another exemplary embodiment, the constant-force spring 136 may be joined to the second pulley 130 in other ways (e.g., adhesive, weld, rivet, etc.). In this configuration, the constant-force spring 136 is coiled around the second pulley 130, sharing an axis B-B, and is configured to be uncoiled when the assembly 100 moves toward the first surface 70 as the sprayhead 16 is undocked, as shown in FIGS. 7 and 9. The constant-force spring 136 provides a constant return force to the sprayhead 16 regardless of how far the sprayhead 16 is removed from the spout 14. In other words, the constant-force spring 136 provides a constant force to the first pulley 120, regardless of the position of the first pulley 120. With a traditional spring, the sprayhead 16 would return to the spout 14 with more violence the further it is withdrawn from the spout 14. In contrast to a traditional spring, the constant-force spring 136 does not respond differently the further it is withdrawn, and provides the same tactile response for a user as a conventional counterweight.

Figure 8:
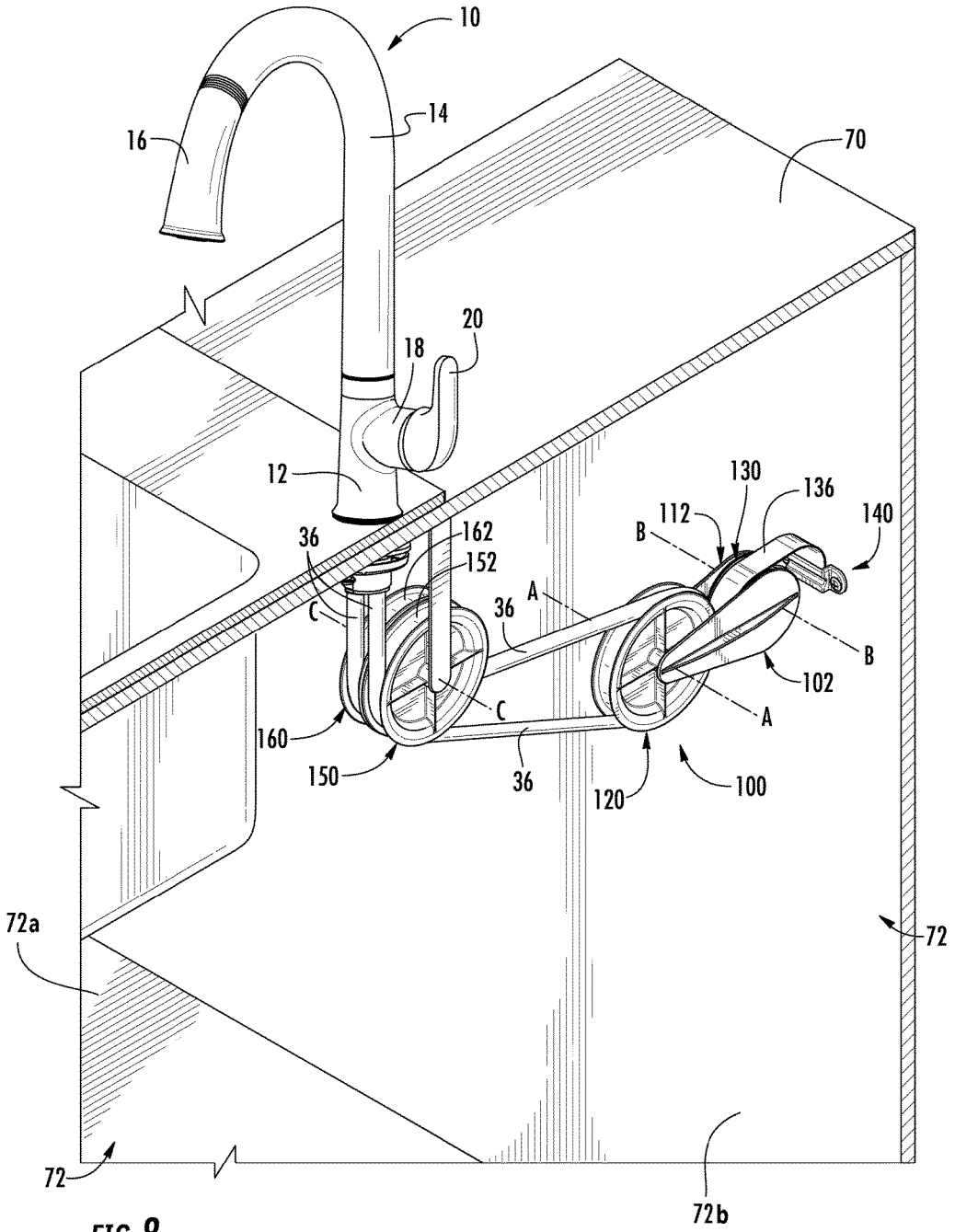
FIG. 8 is a perspective view of a sprayhead retraction assembly and faucet in a docked position, according to another exemplary embodiment.

The assembly 100 includes a mounting bracket 140 coupled to a second surface 72 (see, e.g., FIGS. 7 and 8). The mounting bracket 140 defines a plurality of holes 142 for coupling the mounting bracket 140 to the second surface. According to an exemplary embodiment, screws may be fed through the holes 142 and into the second surface 72 to secure the mounting bracket 140 thereto. According to other exemplary embodiments, the mounting bracket 140 may be coupled to the second surface in other ways (e.g., nail, nut and bolt, adhesive, etc.). As shown in FIGS. 6 and 7, the second surface 72 is a substantially horizontal surface 72*a* (e.g., a bottom surface in a cabinet) beneath the first surface 70. According to another exemplary embodiment, shown in FIGS. 8 and 9, the second surface 72 may be a substantially vertical or other surface 72*b*, as will be described in further detail below. According to other exemplary embodiments, the first surface 70 and second surface 72 may have other orientations, for example, parallel, perpendicular, at an angle relative to each other.

The mounting bracket 140 includes a peg 144 and the constant-force spring 136 further defines a hole 139 at a second end thereof 136*b*. The hole 139 receives the peg 144, coupling the constant-force spring 136 to the mounting bracket 140 and thereby to the second surface 72. The constant-force spring 136 is configured to rotate (i.e., swivel) about the peg 144 (i.e., about an axis defined by the peg 144). The second pulley 130 may rotate about the peg 144 when the constant-force spring 136 rotates about the peg 144. According to an exemplary embodiment, the peg 144 extends from the mounting bracket 140 toward the second surface 72, such that the second end 136*b* of the constant-force spring 136 is positioned between the mounting bracket 140 and the second surface 72. According to another exemplary embodiment, the peg 144 may project from the mounting bracket 140 away from the second surface 72. According to an exemplary embodiment, the hole 139 may receive the peg 144 with an interference fit. The constant-force spring 136 extends between the mounting bracket 140 at the second surface 72 and the second pulley 130. According to another exemplary embodiment, the constant-force spring 136 may be joined to the second surface 72 in other ways (e.g., screw, adhesive, weld, rivet, etc.) with or without the mounting bracket 140. The hole 139 of the constant-force spring 136 may be coupled to the second surface 72 such that the constant-force spring 136 may rotate (i.e., swivel) about the hole 139 (i.e., about an axis defined by the hole 139), without applying additional tension to the constant-force spring 136.

Referring to FIG. 6, the faucet 10 and sprayhead 16 are shown in the docked position. The assembly 100 is holding the hose 36 in tension below the first surface 70 such that the sprayhead 16 is completely received within the spout 14. In this configuration, substantially all of the constant-force spring 136 is coiled around the second pulley 130. The assembly 100 is located at a position near the mounting bracket 140 at the second surface 72*a*, and away from the first surface 70. As the sprayhead 16 is withdrawn by a user from the spout 14 toward an undocked position, the length of hose 36 beneath the first surface 70 shortens and the assembly 100 moves toward the first surface 70, uncoiling the constant-force spring 136. Referring now to FIG. 7, the faucet 10 and sprayhead 16 are shown in the undocked position. As with FIG. 6, the assembly 100 holds the hose 36 in tension below the first surface 70. At least a portion of the constant-force spring 136 is uncoiled to form a straightened length. In the undocked position, a portion of the hose 36 extends between the inlet end 46 of the sprayhead 16 and the top end 64 of the spout 14. According to an exemplary embodiment, a length of the portion of hose 36 between the sprayhead 16 and the spout 14 is approximately twice the straightened length of the constant-force spring 136. In the undocked position, the partially-uncoiled constant-force spring 136 applies a constant force, biasing the sprayhead 16 toward the spout 14. When the user releases the sprayhead 16 from the undocked position, the constant-force spring 136 coils around the second pulley 130, moving the assembly 100 away from the first surface 70. As the assembly 100 moves away from the first surface 70, toward the second surface 72*a*, the first pulley 120 pulls more length of the hose 36 beneath the first surface 70. The portion of the hose 36 extending out from the top end 64 of the spout 14 is withdrawn into the spout 14 and the sprayhead 16 moves toward the spout 14 until it is received in the spout 14. The constant tension applied by the constant-force spring 136 couples the sprayhead 16 to the spout 14 in the docked position until disturbed by the user.

According to an exemplary embodiment, the lateral movement of the assembly 100 is restrained. Unlike a conventional counterweight, the constant tension placed on the hose 36 by the constant-force spring 136 minimizes or eliminates excess slack in the hose 36, thereby limiting movement of the assembly 100 to a straight-line path between the body 12 and the mounting bracket 140.

According to another exemplary embodiment, the second pulley 130 may be axially coupled to a projection extending from the mounting plate 140. The second end 136*b* of the constant force spring 136 is coupled to the first member 102 (e.g., at the second projection 104*b*). In this configuration, as the sprayhead 16 is undocked, the members 102, 112 and the first pulley 120 move toward the surface 70, while the second pulley 130 remains fixed relative to the second surface 72. An uncoiled (i.e., straightened) length of the constant-force spring 136 extends from the first member 102 (e.g., starting at the second end 136*b* of the constant-force spring 136) to the second pulley 130.

Referring to FIGS. 8 and 9, according to another exemplary embodiment, the assembly 100 includes a third, or idler pulley 150. The third pulley 150 is configured to redirect (i.e., change the orientation of) the hose 36 such that the mounting bracket 140 may be joined to the second surface 72*b*, where the second surface 72*b* is substantially vertical (e.g., wall of a cabinet), as shown in FIG. 5. For example, as shown in FIGS. 8 and 9, the hose 36 may extend substantially vertically from the third pulley 150 toward the sprayhead 16 and the hose 36 may extend substantially horizontally from the third pulley 150 toward first pulley 120 and/or the second surface 72*b*. The third pulley 150 defines at least one groove 152 configured to receive the hose 36. The hose 36 is received in the groove 152 of the third pulley 150 between the outlet end 40 of the hose 36 and the first pulley 120. The third pulley 150 may rotate freely about axis C-C, and engage the hose 36 as the sprayhead 16 is undocked and docked. As shown in FIGS. 8 and 9, the third pulley 150 may be offset from and coupled to the underside of the first surface 70. According to other exemplary embodiments, the third pulley 150 may be connected to the assembly 100 in other ways (e.g., free floating, to the second surface 72*b*, etc.).

Referring still to FIGS. 8 and 9, according to another exemplary embodiment, the assembly 100 includes redirecting member 160. The redirecting member 160 is configured to redirect the hose 36. For example, as shown in FIGS. 8 and 9, the hose 36 may extend substantially vertically from the redirecting member 160 toward the valve (not shown) and the hose 36 may extend substantially horizontally from the redirecting member 160 toward the first pulley 120 and/or the second surface 72*b*. According to an exemplary embodiment, the redirecting member 160 defines at least one groove 162 configured to receive the hose 36. The hose 36 is received in the groove 162 of the redirecting member 160 between the inlet end 38 of the hose 36 and the first pulley 120. As shown in FIGS. 8 and 9, the redirecting member 160 may be a fourth pulley, the fourth pulley defining the groove 162. The redirecting member 160 may be coupled to the third pulley 150. According to an exemplary embodiment, the redirecting member 160 is disposed along axis C-C. According to other exemplary embodiments, the redirecting member 160 may take other forms (i.e., guide, track, elbow, collar, etc.) and may redirect the hose 36 in other ways. The redirecting member 160 may be stationary such that it does not move (i.e., rotate) as the sprayhead 16 is undocked and docked. For example, a length of the hose 36 that is received by the redirecting member 160 may not move (i.e., translate) along the redirecting member 160 as the sprayhead 16 is undocked and docked. As shown in FIGS. 8 and 9, the redirecting member 160 may be offset from and coupled to the underside of the first surface 70. According to other exemplary embodiments, the redirecting member 160 may be connected to the assembly 100 in other ways (e.g., free floating, to the second surface 72*b*, etc.).

Referring to FIG. 8, the faucet 10 and sprayhead 16 are shown in the docked position, according to an exemplary embodiment. The assembly 100 is holding the hose 36 in tension below the first surface 70 such that the sprayhead 16 is completely received within the spout 14. In this configuration, substantially all of the constant-force spring 136 is coiled around the second pulley 130. The assembly 100 is located at a position near the mounting bracket 140 at the second surface 72*b*, substantially parallel to the first surface 70. As the sprayhead 16 is withdrawn by a user from the spout 14 toward an undocked position, the length of hose 36 beneath the first surface 70 shortens and rotates around the third pulley 150 and the assembly 100 moves toward the third pulley 150, uncoiling the constant-force spring 136.

Referring now to FIG. 9, the faucet 10 and sprayhead 16 are shown in the undocked position. As with FIG. 8, the assembly 100 holds the hose 36 in tension below the first surface 70. At least a portion of the constant-force spring 136 is uncoiled to form a straightened length. In the undocked position, a portion of the hose 36 extends between the inlet end 46 of the sprayhead 16 and the top end 64 of the spout 14. According to an exemplary embodiment, a length of the portion of hose 36 between the sprayhead 16 and the spout 14 is approximately twice the straightened length of the constant-force spring 136. In the undocked position, the partially-uncoiled constant-force spring 136 applies a constant force, biasing the sprayhead 16 toward the spout 14. When the user releases the sprayhead 16 from the undocked position, the constant-force spring 136 coils around the second pulley 130, moving the assembly 100 away from the third pulley 150. As the assembly 100 moves away from the third pulley 150, toward the second surface 72*b*, the first pulley 120 pulls more length of the hose 36 beneath the first surface 70 and around the third pulley 150. The portion of the hose 36 extending out from the top end 64 of the spout 14 is withdrawn into the spout 14 and the sprayhead 16 moves toward the spout 14 until it is received in the spout 14. The constant tension applied by the constant-force spring 136 couples the sprayhead 16 to the spout 14 in the docked position until disturbed by the user.

The assembly 100 moves laterally, spaced above a floor (e.g., bottom of the cabinet), while the vertical movement of the assembly 100 is restrained. In this configuration, items may be stored under the assembly 100 without being knocked over while the sprayhead 16 is undocked or docked, as is common with a conventional counterweight.

While the prior-discussed embodiments include a faucet 10 having a body 12, a spout 14, and a sprayhead 16, it should be recognized that, according to another exemplary embodiment, the sprayhead 16 may be a standalone sprayhead 16 (e.g., sidespray), without a faucet 10 having a base 12 and a spout 14. According to another exemplary embodiment, the sprayhead 16 may be for a handshower (e.g., deck mount, wall mount, etc.). For a deck mount hand shower, the first surface 70 may be a deck surrounding or forming a bath. For a wall mount handshower, the first surface 70 may be a wall forming a shower.

According to an exemplary embodiment, the assembly 100 may include damping when the sprayhead 16 is returned from an undocked position to a docked position. The damping may be configured to restrict a rate of movement (e.g., withdrawing, retracting) of the sprayhead 16 between the undocked and docked positions, such that the sprayhead 16 is quietly received in the spout 14. According to an exemplary embodiment, the damping includes damping grease disposed between the second pulley 130 and the second projection 104*b*. According to another exemplary embodiment, the damping grease may be disposed between the first pulley 120 and the first projection 104*a*. A viscosity of the damping grease may be selected to correspond with a desired rate of retraction of the sprayhead 16 from the undocked to docked position. According to other exemplary embodiments, other damping mechanisms may be used.

As utilized herein, the terms "approximately," "about," "generally," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of this disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the position of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is to be understood that although the present invention has been described with regard to preferred embodiments thereof, various other embodiments and variants may occur to those skilled in the art, which are within the scope and spirit of the invention, and such other embodiments and variants are intended to be covered by corresponding claims. Those skilled in the art will readily appreciate that many modifications are possible (e.g., variations in sizes, structures, shapes and proportions of the various elements, mounting arrangements, use of materials, orientations, etc.) without materially departing from the novel teachings and advantages of the subject matter described herein. For example, the order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A sprayhead retraction assembly comprising:

a first member defining first and second projections;

a first pulley axially connected to the first projection, the first pulley configured to receive a hose;

a second pulley axially connected to the second projection; and a constant-force spring defining a first end and a second end;

wherein the first end is coupled to the second pulley, such that the constant-force spring is configured to coil around the second pulley; and wherein the second end is configured to be coupled to a surface.

2. The sprayhead retraction assembly of claim 1, further comprising a sprayhead fluidly coupled to a hose, the hose received by the first pulley;

wherein the surface is a second surface;

wherein the hose extends through a first surface; and wherein the sprayhead is disposed above the first surface and the second surface is disposed below the first surface.

3. The sprayhead retraction assembly of claim 2, wherein the second surface is substantially horizontal.

4. The sprayhead retraction assembly of claim 2, wherein when the constant-force spring is coiled around the second pulley, the sprayhead engages a spout in a docked position.

5. The sprayhead retraction assembly of claim 1, wherein the second end of the constant-force spring is coupled to a mounting bracket; and wherein the mounting bracket is coupled to the surface.

6. The sprayhead retraction assembly of claim 1, wherein the second end of the constant-force spring defines a hole; and wherein the second end of the constant-force spring is coupled to the second surface such that the constant-force spring is configured to rotate about the hole.

7. The sprayhead retraction assembly of claim 1, further comprising a second member coupled to the first member, the second member defining a plurality of openings configured to receive the first and second projections.

8. The sprayhead retraction assembly of claim 1, wherein the constant-force spring is configured to provide a constant force to the first pulley independent from a position of the first pulley.

9. A sprayhead retraction assembly comprising:

a first member defining first and second projections;

a first pulley axially connected to the first projection, the first pulley configured to receive a hose;

a second pulley axially connected to the second projection;

a third pulley configured to redirect the hose between an outlet end of the hose and the first pulley;

and a constant-force spring defining a first end and a second end;

wherein the first end is coupled to the second pulley, such that the constant-force spring is configured to coil around the second pulley; and wherein the second end is configured to be coupled to a surface.

10. The sprayhead retraction assembly of claim 9, further comprising the hose and a sprayhead fluidly coupled to the outlet end of the hose;

wherein the hose is received by the first pulley.

11. The sprayhead retraction assembly of claim 10, wherein the surface is a second surface;

wherein the hose extends through a first surface; and wherein the sprayhead is disposed above the first surface and the second surface is disposed below the first surface.

12. The sprayhead retraction assembly of claim 11, wherein the second surface is substantially vertical.

13. The sprayhead retraction assembly of claim 10, further comprising a redirecting member configured to receive and redirect the hose between an inlet end of the hose and the first pulley.

14. The sprayhead retraction assembly of claim 13, wherein the redirecting member is a fourth pulley.

* * * * *